US010220443B2

(12) United States Patent
Langner

(10) Patent No.: US 10,220,443 B2
(45) Date of Patent: Mar. 5, 2019

(54) METHOD FOR PRODUCING A STEEL SHAPED BODY

(71) Applicant: Robert Bosch GmbH, Stuttgart (DE)

(72) Inventor: Heike Langner, Sulz (DE)

(73) Assignee: Robert Bosch GmbH, Stuttgart (DE)

( * ) Notice: Subject to any disclaimer, the term of this patent is extended or adjusted under 35 U.S.C. 154(b) by 579 days.

(21) Appl. No.: 14/901,203

(22) PCT Filed: Jun. 20, 2014

(86) PCT No.: PCT/EP2014/063050
§ 371 (c)(1),
(2) Date: Dec. 28, 2015

(87) PCT Pub. No.: WO2014/206890
PCT Pub. Date: Dec. 31, 2014

(65) Prior Publication Data

US 2016/0136729 A1 May 19, 2016

(30) Foreign Application Priority Data

Jun. 27, 2013 (DE) ..... 10 2013 212 528

(51) Int. Cl.
*B22F 3/10* (2006.01)
*C22C 33/02* (2006.01)
(Continued)

(52) U.S. Cl.
CPC ..... *B22F 3/10* (2013.01); *B22F 1/0062* (2013.01); *B22F 3/1003* (2013.01);
(Continued)

(58) Field of Classification Search
CPC ..... B22F 3/10; B22F 3/1003; B22F 3/1039; B22F 1/0062
(Continued)

(56) References Cited

U.S. PATENT DOCUMENTS 4,665,828 A * 5/1987 Auer ..... F42B 12/06 102/519
6,939,509 B2 9/2005 Kochanek
(Continued)

FOREIGN PATENT DOCUMENTS

CN 1647874 A 8/2005
CN 101925684 A 12/2010
(Continued)

OTHER PUBLICATIONS

International Search Report for Application No. PCT/EP2014/063050 dated Oct. 17, 2014 (English Translation, 2 pages).

*Primary Examiner* — Mark A Chapman

(57) ABSTRACT

The invention relates to a method for producing a steel shaped body, particularly, for example, a component for common rail fuel injection valves, comprising the method steps of: forming a powderous composition based on iron oxide, from oxide particles, with the addition of carbon and micro-alloy elements so as to adjust a bainitic microstructure; heating the powderous composition to a sinter temperature; reducing the shaped body obtained by sintering; and cooling the sintered shaped body to room temperature. As a result, from the three essential state phases in a state diagram (10), specifically the ferrite-perlite state range (11), the bainite state range (12) and the martensite state range (13), preferably the bainitic state phase is formed in a medium temperature range by the ferrite-perlite state range (11) being shifted to longer cooling periods and the martensite state range (13) being shifted to lower temperatures.

14 Claims, 2 Drawing Sheets

(51) Int. Cl.
*B22F 1/00* (2006.01)
*B22F 5/00* (2006.01)

(52) U.S. Cl.
CPC ..... *B22F 3/1021* (2013.01); *B22F 3/1039* (2013.01); *B22F 5/00* (2013.01); *C22C 33/0264* (2013.01); *B22F 2001/0066* (2013.01); *B22F 2301/35* (2013.01); *B22F 2302/105* (2013.01); *B22F 2302/20* (2013.01); *B22F 2302/25* (2013.01); *B22F 2302/253* (2013.01); *B22F 2302/256* (2013.01); *B22F 2999/00* (2013.01)

(58) Field of Classification Search
USPC ..... 419/19
See application file for complete search history.

(56) References Cited

U.S. PATENT DOCUMENTS

| | | | |
|---|---|---|---|
| 2001/0037842 | A1 | 11/2001 | Hayashi et al. |
| 2010/0008812 | A1 | 1/2010 | Kawata |

FOREIGN PATENT DOCUMENTS

| | | | |
|---|---|---|---|
| EP | 1268105 | | 5/2004 |
| EP | 1536028 | | 6/2005 |
| JP | S5763602 | A | 4/1982 |
| JP | H0219406 | A | 1/1990 |
| JP | 2001158934 | A | 6/2001 |
| JP | 2005154796 | A | 6/2005 |
| JP | 2008502803 | A | 1/2008 |
| JP | 2010013696 | A | 1/2010 |
| WO | 03106079 | | 12/2003 |

* cited by examiner

METHOD FOR PRODUCING A STEEL SHAPED BODY

BACKGROUND OF THE INVENTION

The invention relates to a method for producing a steel shaped body, particularly, for example, a component for common rail fuel injection valves.

Steel blanks can be produced by means of smelting metallurgy methods. The raw material in the steel plant consisting of pig iron is smelted via the LD-route or consisting of scrap iron via the so-called electric furnace route, and the desired composition is thereby adjusted in the molten state. After that smelting process, such a steel blank is continuously cast to precursor material in continuous casting plants, which is subsequently rolled out to bar steel in the rolling mill using thermomechanical rolling technology with or without heat treatment subsequently taking place in a targeted manner. The bar steel is then used as the starting material for the metal-cutting manufacturing of corresponding components.

Near-net-shape manufacturing processes, with which metallic components can be produced, are known as powder metallurgical manufacturing processes. This relates to pressing and the subsequent sintering of metallic powders or also to the so-called hot isostatic pressing (HIP). The so-called metal powder injection molding or MIM (metal injection molding) constitutes a special form. Metallic powders, which are pre-alloyed corresponding to the desired target composition, are thereby used as a starting basis.

A method for manufacturing metal bodies is known from the European patent publication EP 1 268 105 B1. In this method, metal compound particles are mixed with a binder and pressed to formed components. The binder is subsequently removed and the metal compound is reduced to metal by means of a gas flush with reducing gas at high temperatures, wherein the reduction is carried out at temperatures below the sinter temperature of the reduced metal compound and a binder mixture consisting of a removable and a stable component is used, whereupon the removable component is extracted. The shaped body is subsequently subjected to a temperature of between 550° C. and 95° C. in oxidizing atmospheres, and the stable binder content is thereby converted into gaseous decomposition products and removed from the matrix, whereupon the shaped body is pre-reduced in atmospheres containing carbon and subsequently post-reduced with gas containing hydrogen. This prior art, however, does not explicitly relate to the production of bainitically formed steel shaped bodies having an intrinsically pronounced stability.

SUMMARY OF THE INVENTION

The method according to the invention has the advantage that, by means of a predefined powderous initial composition for the steel shaped body, said composition being based on iron oxide, for example ($Fe_3O_2$), and the admixture of oxide particles and micro-alloy elements, a bainitic phase can be adjusted in a preferable manner during the succeeding process steps. As a result, a near-net-shape method for producing a powder metallurgical steel shaped body is achieved by means of powder injection molding, said shaped body having the material properties which correspond to those of a conventionally produced high-tensile steel. The steel shaped body produced according to the inventive method is further characterized in that the shaped body is slow in conversion due to the chemical composition thereof, such that a bainitic microstructure with advantageous mechanical properties is also produced when the air cools down. A relatively high mechanical or static strength in the range of approximately 1100 to 1600 MPa and an associated high ductility, which manifests itself by means of uniform elongations between 10% and 15%, correspond to such a bainitic microstructure. Due to these material properties, the method according to the invention is suited to the production of structural components which by nature are subject to high stress, in particular for common rail fuel injection valves; however, also for the production of other components which are cyclically subjected to high stress. The post-processing effort, for example by means of machining, can furthermore be advantageously reduced in a cost saving manner due to the near-net-shape method vis-à-vis the prior art.

According to one preferred embodiment of the method according to the invention, the oxide particles of the powderous composition comprise as element components: manganese at a content level of approximately 0.8 to 1.9%, silicon at a content level of approximately 0.3 to 1.5%, chrome at a content level of approximately 0.1 to 1.8%, nickel at a content level of approximately 0.2 to 1.5% and molybdenum at a content level of approximately 0.1 to 0.5%. The aforementioned element components form together with the iron oxide basis the base composition of the starting material, whereby a bainitic microstructure can be achieved during the subsequent steps of the process. The added micro-alloy elements comprise an aluminum content of 0.01 to 0.04%, and/or a boron content of ≤0.00025% and/or a vanadium content of 0.05 to 0.20%. A variant of the method according to the invention can then consist of adding carbon by means of a process gas, preferably by means of carbon monoxide. According to another variant, carbon can be added by admixing graphite and/or carbides. According to a modification to the method according to the invention, the addition of carbon can take place by means of a binder containing hydrocarbons, wherein, in this case, a process step following the sintering for debinding the shaped body is looped into the inventive method.

An advantageous modification to the method according to the invention, which leads to the intrinsic strength of the shaped body being increased, consists of admixing carbide forming elements to the composition based on iron oxide, wherein the carbide forming elements comprise a titanium content of 0.01 to 0.03% and/or a niobium content of 0.01 to 0.04%.

According to one embodiment variant of the method according to the invention, superfine-grained oxide ceramic particles are added to the powderous composition, wherein the oxide ceramic particles are formed from one or a plurality of chemical compounds of the group: zirconium oxide, silicon oxide, aluminum oxide, yttrium oxide, silicon nitride, silicon carbide. As a result, the static strength of the shaped body formed at the end of the inventive method can be increased.

BRIEF DESCRIPTION OF THE DRAWINGS

Exemplary embodiments of the invention are explained in greater detail in the following description and in the attached drawings. In the schematically depicted views of the drawings.

DETAILED DESCRIPTION

Figure 1:
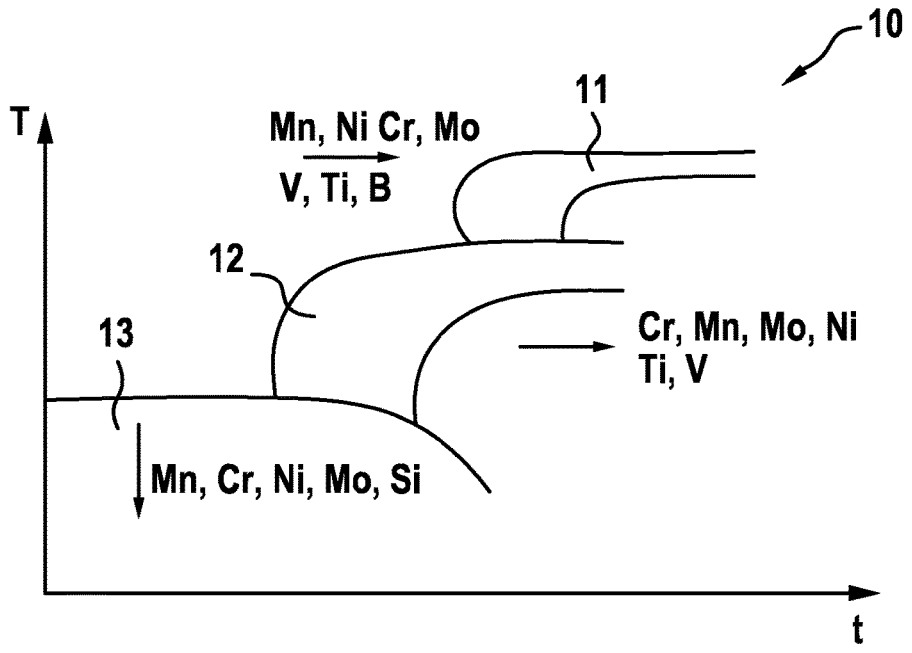
FIG. 1 shows a diagram for depicting the mechanism of action of the method according to the invention, wherein the temperature profile of different state ranges is depicted versus the temporal cooling behavior.

FIG. 1 illustrates the operating principle of the method according to the invention using a schematically depicted state diagram 10. The temperature profile for the essential state ranges of steel is plotted on the ordinate axis of said state diagram 10 versus the cooling period extending along the abscissa axis thereof. The ferrite-perlite state range 11 is depicted in the upper temperature range of the state diagram 10, the bainite state range 12 in the middle temperature range and the martensite state range in the lower temperature range. The mechanism of action according to the invention now consists of forming a powderous composition which is based on iron oxide, for example $Fe_3O_2$, by means of the addition of metal oxides such as nickel oxide or molybdenum oxide as well as by means of the addition of metallic powder such as chrome and in which composition, during sintering, the phase transformation from the austenite to the ferrite-perlite state range 11 is suppressed or at least shifted to cooing periods of such a length that bainite is formed even at slow cooling rates from the sinter temperature to room temperature. To this end, the bainite state range 12 is widened on the temperature axis T as well as on the time axis t by the addition of alloy elements, such as chrome (Cr), manganese (Mn), molybdenum (Mo), nickel (Ni) and furthermore by the addition of micro-alloy elements, such as titanium (Ti), vanadium (V) and/or boron (B). Thus, the ferrite-perlite state range 11 is shifted to the right due to the addition of alloy elements, i.e. towards longer cooling periods t and the martensite state range 13 is shifted downwards in the state diagram 10, i.e. towards lower temperatures. As a result, it is possible according to the invention to generate a so-called slow conversion material which is no longer formed martensitically but rather bainitically. According to the invention, the micro-alloy elements and aluminum together with carbon and/or nitrogen form superfine precipitates, which impede the grain growth during the sintering process and thus lead to a superfine-grained structure.

Starting from an iron oxide basis, the base composition required for that purpose has a manganese content of 0.8 to 1.9%, a silicon content of 0.2 to 1.5%, a chrome content of 0.1 to 1.2%, a nickel content of 0.2 to 1.5% and a molybdenum content of 0.1 to 0.5%.

The metallic powders can be added as pre-alloys, such as, e.g., ferromanganese or ferrotitanium.

Figure 2:
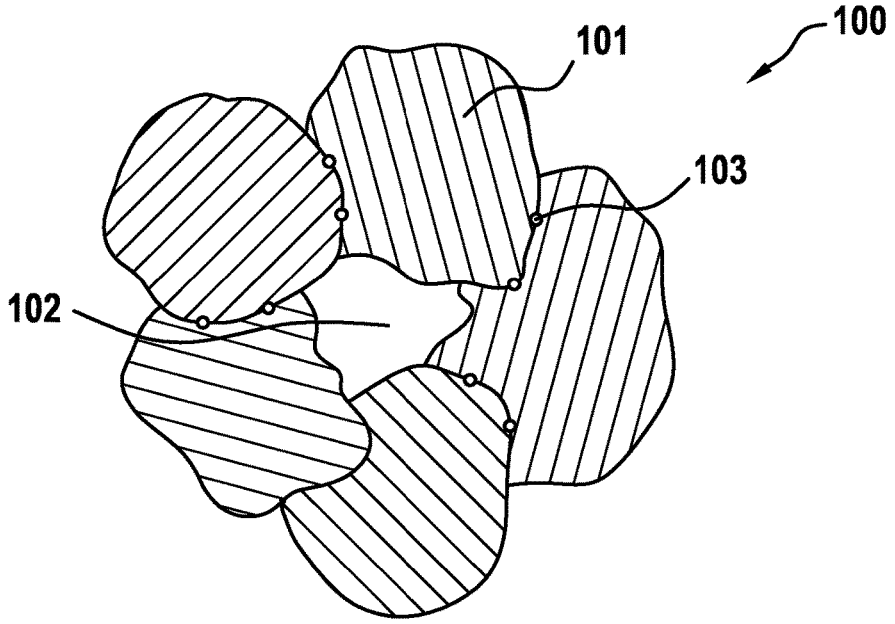
FIG. 2 shows a microstructure produced by the inventive method of superfine-grained bainite with small percents of ferrite and perlite by volume in a highly schematic view.

FIG. 2 shows a first exemplary embodiment of the invention. This embodiment relates to a bainitic microstructure 100 which is formed from bainite grains and very small proportions of ferrite-perlite grains 102 and has superfine precipitates 103 at the grain boundaries. The microstructure is of superfine-grained design, wherein the bainite grains 101 have a bainite needle length which is significantly smaller than 20 μm. The bainitic microstructure furthermore has a high static strength Rm which lies in the range of approximately 1000 to 1150 MPa. In addition, the micro-alloy elements: aluminum at a content level of 0.01 to 0.04%, boron at a content level of ≤0.00025% and vanadium at a content level of 0.05 to 0.20% are added to the base composition, wherein the addition can be effected by only one element selected from this group or by a mixture of the individual elements.

In order to achieve the high static strength, the addition of carbon at final content levels of 0.15 to 0.3% is furthermore required. The introduction of the carbon can either take place via the process gas, e.g. carbon monoxide (CO) or via the addition of graphite by graphite being admixed to the base composition. A further option consists of admixing reducible carbides, e.g. SiC which dissolve during the sintering process, so that free carbon then remains which can react with the oxide powder. The input of carbon can furthermore take place via a binder which is required for producing a sprayed material and is formed from a resin, i.e. a hydrocarbon compound.

Figure 3:
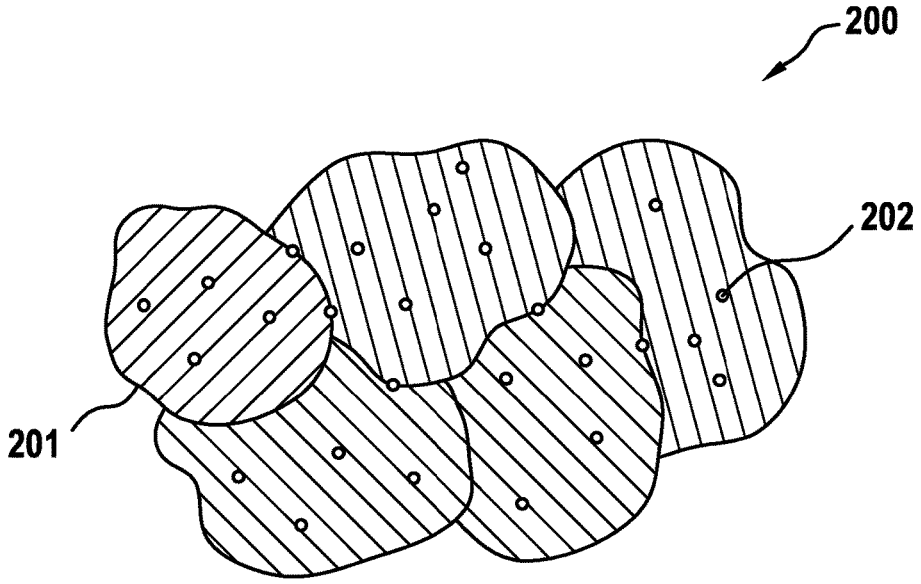
FIG. 3 shows a microstructure produced by the inventive method of superfine-grained bainite and carbides that have been super finely precipitated in a highly schematic view.

FIG. 3 shows a second exemplary embodiment of the invention. This relates to a fully bainitic microstructure 200 consisting of bainite grains 201, which contain the nano-carbides 202, i.e. super-fine carbide and carbon nitride precipitates in the nanometer range. The microstructure 200 has a static strength which varies from approximately 1100 to 1600 MPa. In contrast to the first exemplary embodiment, an additional strength increase is achieved in the second exemplary embodiment due to the fact that an addition of carbide forming elements takes place which in forming superfine carbide precipitates, the size of which lies in the range of a few nanometers, impede otherwise possible dislocation motions in the metal grid and thus increase the strength without negatively affecting the ductility. Titanium at a content level of 0.01% and/or niobium at a content level of 0.01 to 0.04% are used as carbide forming elements which are admixed to the oxide powder mixture according to exemplary embodiment 1 either simultaneously together or also individually as a function of the desired target strength. The feed of carbon and/or nitrogen is furthermore required for forming the carbides. In contrast to the first exemplary embodiment, the feed of carbon at a higher concentration takes place in this exemplary embodiment so that a carbon surplus is adjusted in the metal grid, which leads to a grid strain and to a precipitate correlated therewith in the form of carbides as a second phase. The input of carbon can either take place as a process gas, by the addition of graphite or by means of a binder. The—additional—introduction of nitrogen at final content levels of 0.01 to 0.03% can take place as a process gas, e.g. $N_2$ or $NH_3$ during sintering because nitrogen can also form a second phase in the metal grid.

Figure 4:
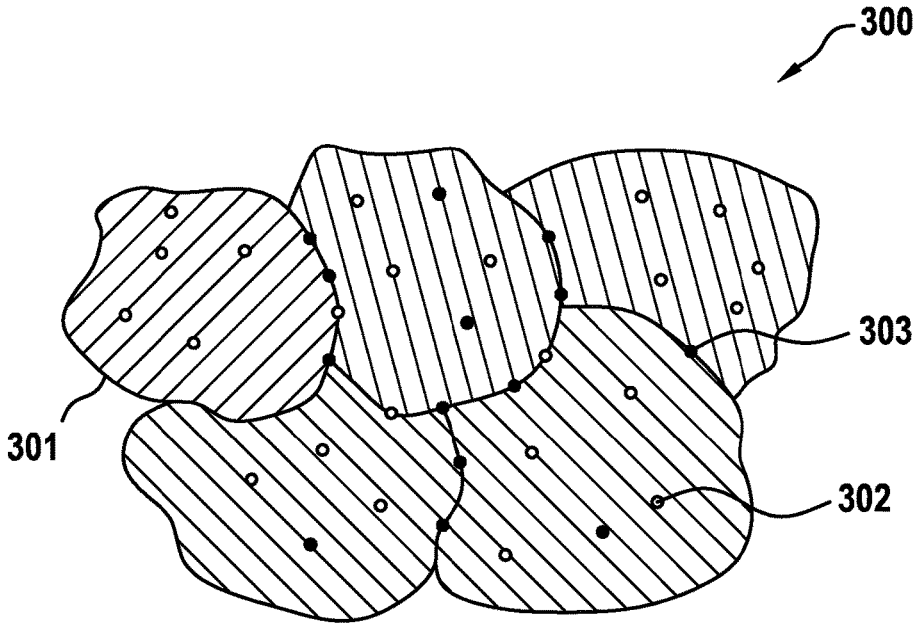
FIG. 4 shows a microstructure produced according to the inventive method of superfine-grained bainite and non-metallic oxide particles as well as of superfine-grained carbides in a highly schematic view.

FIG. 4 shows a third exemplary embodiment of the invention. This embodiment relates to a microstructure 300 consisting of superfine-grained bainite 301, carbide or carbon nitride precipitates 302 as well as oxide ceramic particles 303. In contrast to the second exemplary embodiment, the admixture of superfine-grained oxide ceramic particles having a size in the sub-micrometer range additionally takes place in this exemplary embodiment. Zirconium oxide ($ZrO_2$), silicon dioxide ($SiO_2$), aluminum oxide ($Al_2O_3$), yttrium oxide ($Y_2O_3$), silicon nitride ($Si_3N_4$) and silicon carbide (SiC) are provided as oxide ceramic particles. These particles are added to the starting mixture and remain intact across the individual method steps, i.e. these compounds do not dissolve in the metal grid during the reduction sintering process but block an otherwise possible dislocation movement in the metal grid due to their size and distribution within the grid by said compounds forming an exogenous and thermally stable second phase in the blank material, i.e. in the bainitic base microstructure. As a result, the static strength Rm of the blank material obtained at the end of the method according to the invention is increased without significantly impairing the ductility thereof.

In summary, the method according to the invention for producing a steel shaped body respectively blank, in particular a component, comprises the method steps of: forming a powderous composition based on iron oxide from oxide particles and binders with the addition of carbon and micro-alloy elements so as to adjust a bainitic microstructure; pressing a blank; heating the blank to an isothermal hold stage between 450° C. and 600° C. for debinding, wherein a binder containing hydrocarbons is removed; heating to a sinter temperature in order to reduce the shaped body obtained by pressing; and cooling the sintered shaped body to room temperature, wherein a predefined cooling or respectively temperature gradient is set for the cooling process. As a result, from the three essential state phases in a state diagram 10, specifically the ferrite-perlite state range 11, the bainite state range 12 and the martensite state range 13, preferably the bainitic state phase is formed in a medium temperature range by the ferrite-perlite state range 11 being shifted to longer cooling periods and the martensite state range 13 being shifted to lower temperatures.

The invention claimed is:

1. A method for producing a steel shaped body, comprising the following method steps:

forming a powderous composition based on iron oxide, from solid oxide particles, with the addition of carbon and at least one micro-alloy element so as to adjust a bainitic microstructure, heating the powderous composition to sinter temperature, reducing the shaped body obtained by sintering, and cooling the sintered shaped body to room temperature.

2. The method according to claim 1, characterized in that the oxide particles of the powderous composition comprise as element components: manganese at a content level of approximately 0.8 to 1.9%, silicon at a content level of approximately 0.3 to 1.5%, chrome at a content level of approximately 0.1 to 1.8%, nickel at a content level of approximately 0.2 to 1.5% and molybdenum at a content level of 0.1 to 0.5%.

3. The method according to claim 1, characterized in that micro-alloy elements are added to the powderous composition based on iron oxide, said micro-alloy elements comprising aluminum at a content level of 0.01 to 0.04% and/or boron at a content level of ≤0.0025% and/or vanadium at a content level of 0.05 to 0.20%.

4. The method according to claim 1, characterized in that carbon is added by means of a process gas.

5. The method according to claim 1, characterized in that carbon is added by admixing graphite and/or carbides.

6. The method according to claim 1, characterized in that carbon is added by means of a binder containing hydrocarbons.

7. The method according to claim 6, characterized in that a process step is carried out to debind the shaped body.

8. The method according to claim 1, characterized in that the addition of carbon results in a final content in the range between approximately 0.15 to 0.3%.

9. The method according to claim 1, characterized in that carbide forming elements are admixed to the composition based on iron oxide, the carbide forming elements comprising titanium at a content level of approximately 0.01 to 0.03% and/or niobium at a content level of approximately 0.01 to 0.04%.

10. The method according to claim 9, characterized in that carbon and/or nitrogen is/are introduced together with the carbide forming elements.

11. The method according to claim 10, characterized in that nitrogen at a final content level in the range of approximately 0.01 to 0.03% is introduced as a process gas by means of $N_2$ or $NH_3$ during sintering.

12. The method according to claim 10, characterized in that nitrogen at a final content level in the range of approximately 0.01 to 0.03% is introduced as a process gas.

13. The method according to claim 1, characterized in that superfine-grained oxide ceramic particles are admixed to the powderous composition, the oxide ceramic particles being formed from one or a plurality of chemical compounds of the group: zirconium oxide, silicon oxide, aluminum oxide, yttrium oxide, silicon nitride, silicon carbide.

14. The method according to claim 1, characterized in that carbon is added by means of carbon monoxide.

* * * * *